US005476198A

United States Patent [19]

Jouillat et al.

[11] Patent Number: 5,476,198

[45] Date of Patent: Dec. 19, 1995

[54] LIQUID DISPENSER DEVICE WITHOUT A DIP-TUBE

[75] Inventors: Claude Jouillat, Montigny-Sur-Avre; Olivier de Pous, Neuilly-Sur-Seine, both of France

[73] Assignee: Valois S.A., Le Neubourg, France

[21] Appl. No.: 249,234

[22] Filed: May 25, 1994

[30] Foreign Application Priority Data

May 26, 1993 [FR] France ..... 93-06310

[51] Int. Cl.[6] ..... B67D 5/42

[52] U.S. Cl. ..... 222/328; 222/321.5; 222/377

[58] Field of Search ..... 222/321.7, 321.5, 222/377, 321.9, 454, 456, 328, 584, 463, 394, 402.1, 207, 402.2

[56] References Cited

U.S. PATENT DOCUMENTS

| | | | |
|---|---|---|---|
| 1,896,405 | 2/1933 | Hauser | 222/584 |
| 1,964,609 | 6/1934 | Cone | 222/584 |
| 2,132,657 | 10/1938 | Smith | 222/584 |
| 3,029,001 | 4/1962 | Blish | 222/207 |
| 3,369,713 | 2/1968 | Godschalk, Jr. | 222/454 X |
| 3,382,870 | 5/1968 | Parry . | |
| 3,756,474 | 9/1973 | Ricco | 222/377 X |
| 3,991,915 | 11/1976 | Kinnavy | 222/394 |
| 4,159,791 | 7/1979 | Crutcher | 222/454 |
| 4,880,151 | 11/1989 | Sheperd | 222/394 |
| 5,259,536 | 11/1993 | Reyman | 222/454 X |
| 5,279,450 | 1/1994 | Witt, Jr. | 222/377 |

FOREIGN PATENT DOCUMENTS

| | | |
|---|---|---|
| 0307310 | 3/1989 | European Pat. Off. . |
| 1525560 | 4/1968 | France . |
| 1539702 | 8/1968 | France . |
| 2311723 | 12/1976 | France . |

*Primary Examiner*—Kevin P. Shaver

*Attorney, Agent, or Firm*—Sughrue, Mion, Zinn, Macpeak and Seas

[57] ABSTRACT

A dispenser pump 1 is mounted on a liquid receptacle 2, in which the liquid 3 forms a free surface 4. A liquid retention member 6 communicates with a pump inlet orifice 5 and with the receptacle, and is adapted to receive a certain volume of liquid 15 when the device is shaken or tilted relative to an upright position in which the pump is at the top of the receptacle, and to retain the liquid volume in communication with the inlet orifice of the pump when the device is back in the upright position.

14 Claims, 4 Drawing Sheets

LIQUID DISPENSER DEVICE WITHOUT A DIP-TUBE

The present invention relates to a liquid dispenser device usable in the upright position and not including a dip-tube.

BACKGROUND OF THE INVENTION

More specifically, the invention relates to a dispenser device adapted to be held in the hand and which includes a pump mounted on a container of liquid, the pump being above the free surface of the liquid in the container while the device is in use.

In the prior art, such devices have always included a dip-tube which extends from the dispenser down to the bottom of the container. Such a dip-tube presents several drawbacks. Firstly, it makes certain original bottle designs impossible, particularly in the field of perfumery. In addition a dip-tube in a transparent receptacle is disadvantageous from the point of view of appearance, and the wide variety of receptacle shapes makes it necessary to manufacture special tubes for practically each special shape. Furthermore, variations in the length of the tube in relation to the bottom of glassware make it impossible for the dip-tube to be defined industrially.

In the prior art, there exist so-called "squeeze-bottle" devices in which the liquid is expelled through an outlet duct by deforming the flexible wall of the receptacle. Such a device is described in documents FR-A-1 539 702, FR-A-1 525 560, and 3 382 870. These documents also disclose the use of a retention member for defining a single dose. However, none of those devices operate with a precompression pump that delivers one or more predetermined doses very accurately. Similarly, those devices cannot be fitted to receptacles having rigid walls, such as glass perfume bottles, for example.

OBJECT AND SUMMARY OF THE INVENTION

The present invention therefore provides a liquid dispenser device including a dispenser mounted on a receptacle containing said liquid, in which the liquid forms a free surface inside the receptacle and the dispenser includes an inlet orifice which is disposed above the free surface during normal operation of the dispenser; wherein the dispenser is a pump including a pump body, and wherein the device includes a liquid retention member which communicates with the inlet orifice of the pump and with the receptacle, the liquid retention member being adapted to receive a certain volume of liquid when the device is shaken or tilted relative to an upright position in which the pump is at the top of the receptacle, and being adapted to retain the volume of liquid in communication with the inlet orifice of the pump when the device is in the upright position.

Thus, the volume of liquid retained by the retention member constitutes an intermediate store of liquid that enables the device to be actuated one or more times.

In one embodiment, the retention member is in the form of a cup which is disposed around and beneath the pump when the device is in its upright position.

In another embodiment, the retention member is fixed to the pump body, advantageously by mutual engagement.

Advantageously, the retention member includes a bottom and a cylindrical side wall having an outside diameter that is slightly less than the inside diameter of the neck of the receptacle, the retention member further including a plurality of flexible tabs disposed around the top edge of its side wall and flaring towards the neck of the receptacle in a direction that makes an angle with the vertical, the top ends of the flexible tabs forming a notional circle whose diameter is greater than the inside diameter of the neck of the receptacle, the flexible tabs being capable of folding inwards when the the retention member is put into place inside the neck of the receptacle and then of returning to their flared shape, thereby optionally coming into abutment via their top ends against the wall of the receptacle situated beneath said neck, while the pump is being mounted on the receptacle.

In another embodiment, the retention member includes a bottom and a cylindrical side wall having an annular surface at the top edge thereof extending substantially horizontally outwards from the retention member, the annular surface resting on the top end of the neck of the receptacle, the cylindrical side wall of the retention member including at least one opening enabling liquid to pass from the container into the retention member.

In a variant, the retention member includes a substantially cylindrical rim around the outside end of said horizontal annular surface and extending both ways from the annular surface, the cylindrical rim including fixing means in its bottom portion for fixing to the neck of the receptacle.

In an embodiment, the fixing means include snap-fastening tabs that engage the neck of the receptacle, the cylindrical rim being of the snap-fastening ring type. In another embodiment, the fixing means include an inside thread that co-operates with an outside thread on the neck of the receptacle, the cylindrical rim being of the screw cap type.

Advantageously, the retention member is made of a material that is sufficiently flexible to act as a sealing gasket in the neck of the receptacle.

Preferably, the pump body has ribs or grooves in its portion situated inside the container serving to retain a certain quantity of liquid when the device is tilted or shaken, the quantity of liquid then flowing along the pump body into the retention member under the effect of gravity when the device is put back into the upright position.

In another embodiment of the invention, the retention member includes a cavity adapted to retain the liquid by capillarity. The cavity is disposed beneath the inlet orifice of the pump, and is downwardly open when the device is in the right-way up position. The cavity may include inside ribs to increase the area of contact between the wall of the cavity and the volume of liquid retained in the cavity.

To refill the liquid retention member, it is necessary to turn the device upside-down or to shake it. It is possible that a user will not always think of turning the device upside-down or of shaking it before actuating it, in which case actuation outputs no liquid and may unprime the pump. To avoid that drawback, the outside shape of the device may be such as to ensure that when put down, it can be stable only when in a position that is upside-down or inclined.

A first application of the invention relates to pumps mounted on containers made of transparent material, e.g. perfume bottles made of glass or of crystal. In that application, the device can be particularly advantageous since it eliminates the usual dip-tube which is particularly unattractive in a transparent flask.

BRIEF DESCRIPTION OF THE DRAWINGS

Other characteristics and advantages of the invention appear from the following detailed description of various embodiments of the invention, given by way of non-limiting example and described with reference to the accompanying drawings.

In the drawings.

MORE DETAILED DESCRIPTION

Figure 1:
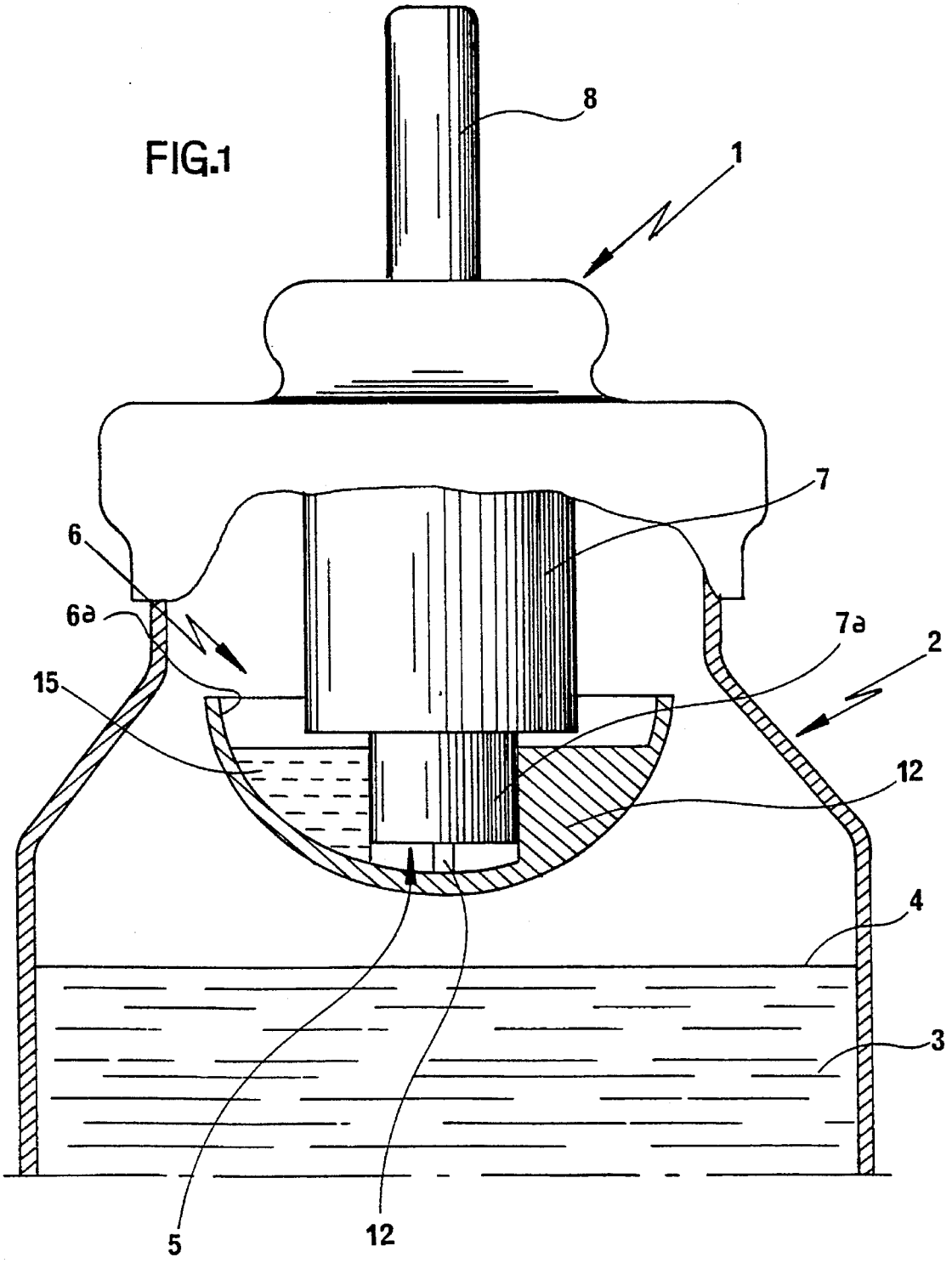
FIG. 1 is a fragmentary section view through a device constituting a first embodiment of the invention and shown the right-way up.

The device of FIG. 1 comprises a pump 1 mounted on a receptacle 2. The receptacle 2 is filled with a liquid 3 that has a free surface 4. The volume situated above the free surface 4 may be empty or it may be filled with air or some other gas, at atmospheric pressure or at some other pressure (e.g. at higher than atmospheric pressure).

The pump 1 includes a pump body 7 having an inlet end 7*a* provided with an inlet orifice 5 that is in communication with the receptacle 2. The pump 1 also includes a hollow actuator rod 8 slidably mounted in the pump body 7 and controlling a piston (not shown). The pump 1 may also include a pushbutton 10 (FIG. 6) that is mounted on the actuator rod 8. The pushbutton includes an outlet orifice that communicates with the actuator rod 8 to enable a dose of liquid to be expelled.

In the vicinity of the inlet orifice 5 of the pump 1 there is disposed a retention member 6 which is constituted in this case by a cup, which member is disposed around and beneath the orifice 5 in the disposition shown in FIG. 1, and is upwardly opened under such circumstances. The cup may be made of a plastics material or of glass, for example. Advantageously, the cup 6 includes ribs 12, e.g. four such ribs, enabling the cup 6 to be fixed to the pump body 7, e.g. by engaging the inlet end 7*a* of the pump body (generally referred to as the tube-carrier).

Figure 2:
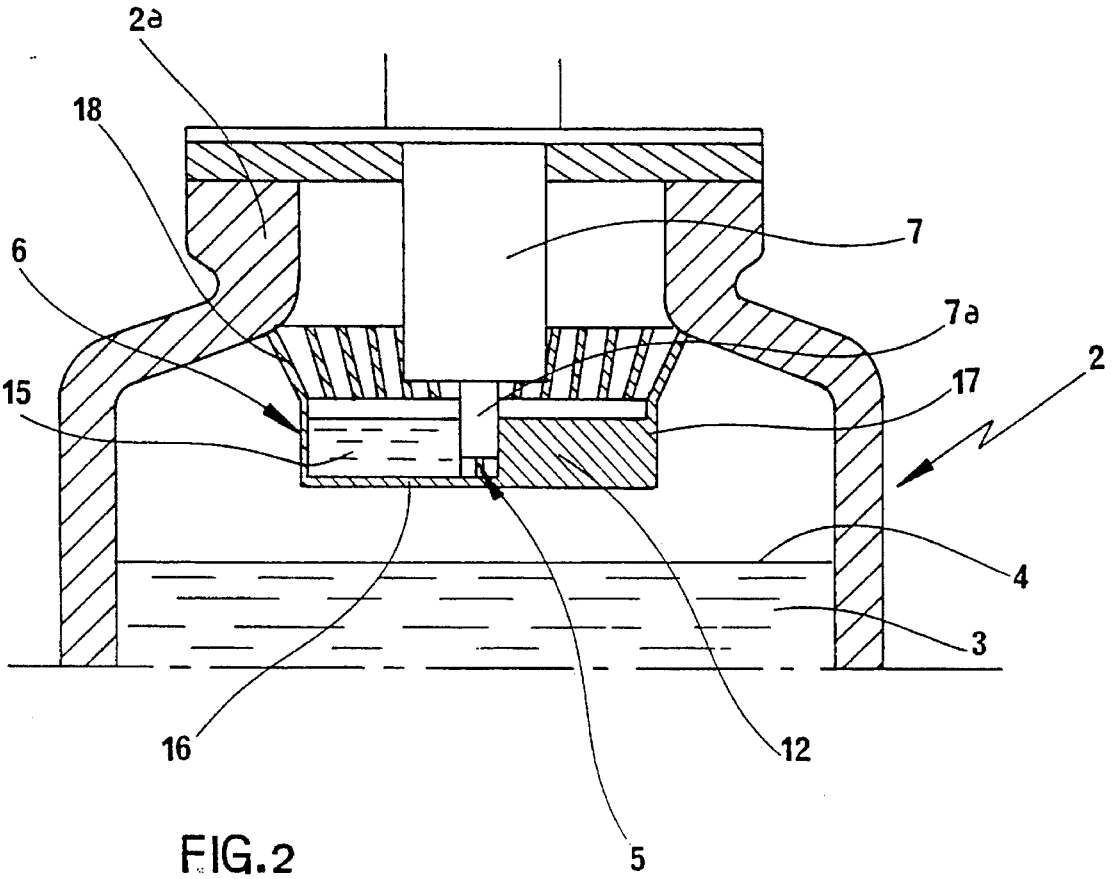
FIG. 2 is a fragmentary section view through a variant of the FIG. 1 device.
Figure 3:
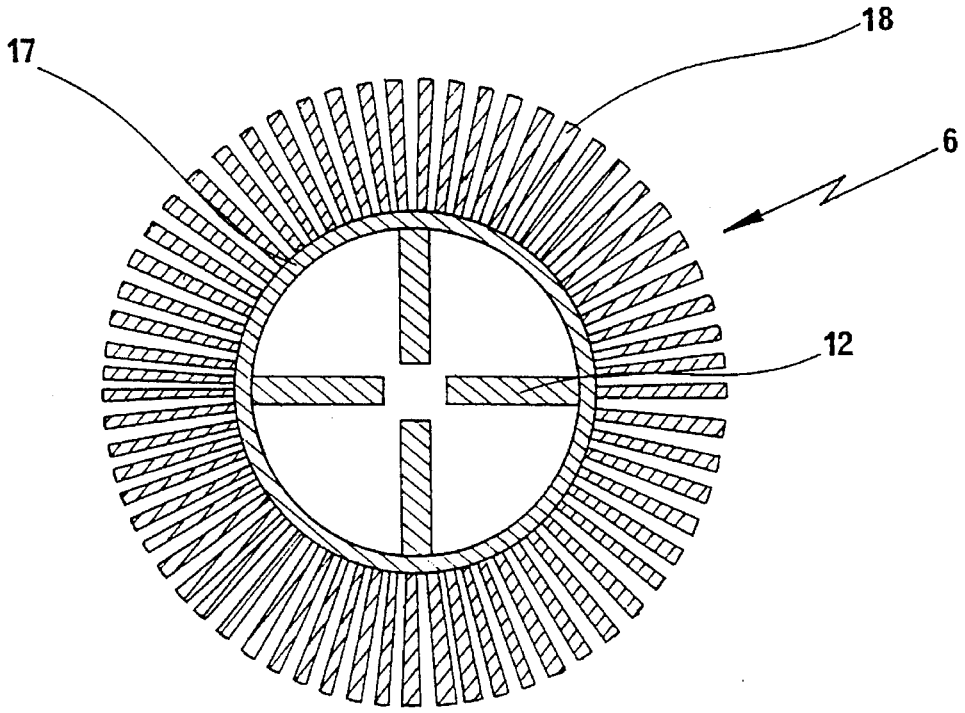
FIG. 3 is a plan view of the cup in the device shown in FIG. 2.

FIGS. 2 and 3 show a variant of the FIG. 1 cup. In this embodiment, the cup 6 has a bottom 16 and a side wall 17 that is substantially cylindrical and that has an outside diameter that is preferably slightly smaller than the inside diameter of the neck 2*a* of the receptacle 2.

Advantageously, flexible tabs 18 may be disposed around the top edge of the side wall 17 so as to flare away from the cup towards the neck 2 of the container by extending at an angle to the wall. Thus, the top ends of the flexible tabs 18 form a notional circle of diameter greater than the inside diameter of the neck of the receptacle. While the pump body 7 and the cup 6 are being put into place through the neck 2*a* of the receptacle, the flexible tabs 18 fold inwards so as to slide along the neck, after which they splay outwards, optionally coming into abutment via their top ends against the wall of the receptacle situated beneath the neck 2*a*. In addition to increasing the effect of capillarity above the cup 6, thereby ensuring that the cup is completely filled when the device is actuated, the flexible tabs 18 guarantee that the device is tamperproof. Any attempt at withdrawing the pump 1 from the receptacle, e.g. to refill it without the knowledge of the manufacturer, will cause the cup 6 to drop to the bottom of the receptacle 2, with the cup no longer being capable of passing through the neck 2*a* of the receptacle 2 because of the presence of the flexible tabs 18.

Figure 4:
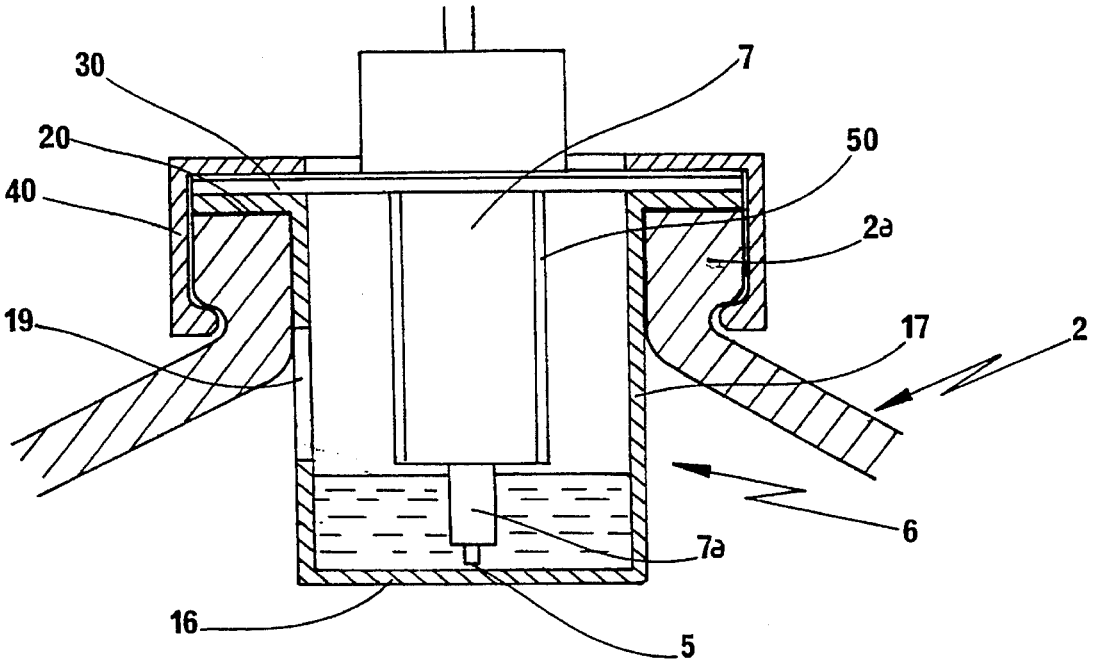
FIG. 4 is a section view through a device constituting another embodiment of the invention.
Figure 5:
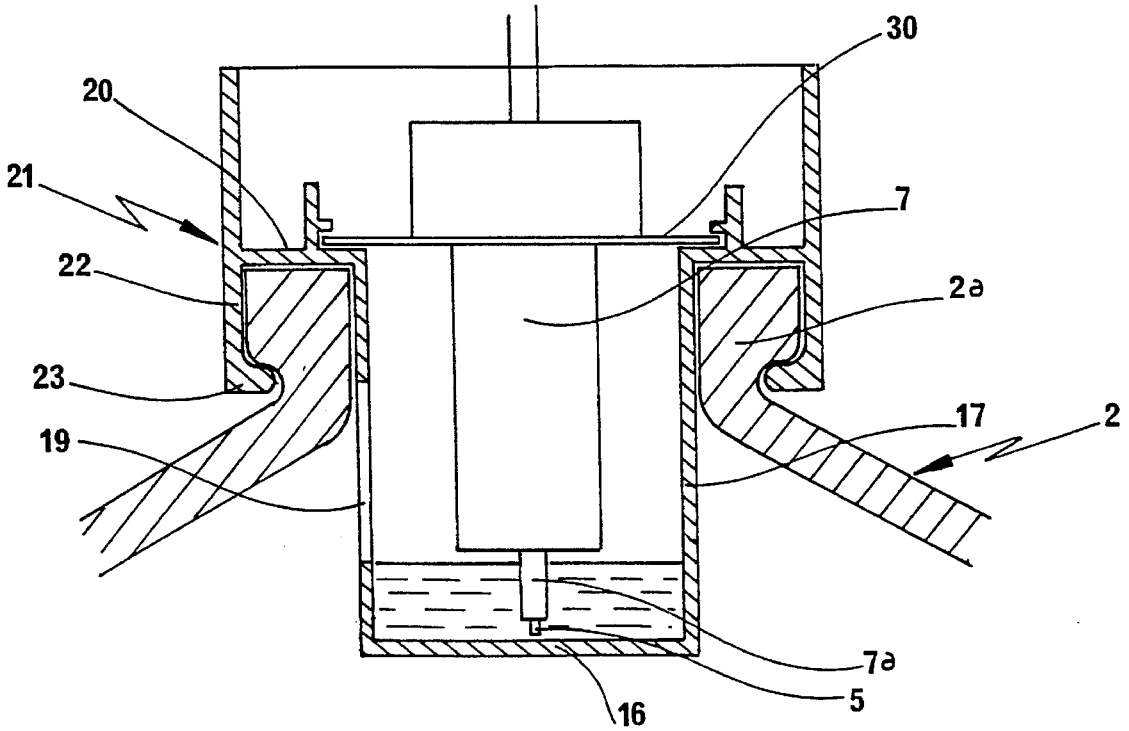
FIG. 5 is a section view through a variant of the FIG. 4 device.

FIGS. 4 and 5 show another embodiment of the invention. In this case, the cup 6 is fixed to the neck 2*a* of the receptacle. It includes a bottom 16 and a cylindrical side wall 17 extending over the full height of the neck 2*a* of the receptacle and including at least one opening 19 to allow the liquid contained within the receptacle 2 to pass into the cup 6. At the top end of the side wall 17, an annular flange 20 extends outwards relative to the cup 6 so as to be substantially horizontal. The annular surface 20 rests on the top end of the neck 2*a* of the receptacle when the device is put into place in the receptacle. The cup 6 and the pump body 7, a portion 30 of which also extends above the top end of the neck 2*a* of the receptacle, are then fixed to the neck of the receptacle by conventional fixing means 40, e.g. such as a snap-fastening ring, as shown in FIG. 4.

In a variant of this device, shown in FIG. 5, the cup and the fastening means constitute a one-piece assembly, the cup 6 including around the outside edge of the horizontal annular surface 20 a rim 21 that is substantially cylindrical and that extends vertically both ways from the annular surface 20. The bottom portion 22 of the cylindrical rim-21 includes means for fixing the device to the neck of the receptacle. These fixing means may include snap-fastening tabs 23 that engage the neck of the receptacle, as shown in FIG. 5. Thus the cylindrical rim 21 is analogous to a "snap-fastening" ring of a kind well known in the state of the art. Alternatively, the fastening means may also include an inside thread that co-operates with an outside thread on the neck of the receptacle, in which case the cylindrical rim 21 is of the screw cap type.

Advantageously, the retention member, i.e. the cup 6 in the embodiments described above, is made of a material that is sufficiently flexible to ensure sealing at the neck of the receptacle. By way of example, such a material may be an elastomer or a thermoplastic-elastomer (TPE) type material, and sealing may be provided either vertically against the inside of the glass neck via the side wall 17, or horizontally on the top end of the neck of the receptacle, via the horizontal annular surface 20.

Although the cup 6 is shown in FIGS. 2, 4, and 5 as having a flat bottom, it could also be tapering in shape leading to a bottom 16 of minimal size, or else it could be hemispherical in shape, as shown in FIG. 1.

The device operates as follows.

Prior to actuating the device, it is shaken or tilted or turned upside-down, so that the pump 1 is lower than the receptacle 2. The liquid 3 then comes into the vicinity of the inlet orifice 5 of the pump. Thereafter, the device is turned back upright so that the pump 1 is disposed at the top of the receptacle 2. During this turning over movement, a certain volume 15 of liquid remains inside the cup 6. Liquid is retained inside the cup 6 partially because the movement of turning the flask upright up is quite quick. However this retention of liquid is also due to capillarity, because of the contact area of the liquid engaging the inside 6*a* of the cup 6. Advantageously, the inside 6*a* of the cup 6 may be provided with ribs to increase the contact area between the liquid and the inside 6*a* of the cup, so as to increase liquid retention. As shown in FIG. 4, the portion of the pump body 7 situated inside the receptacle 2 may be provided with grooves or ribs 50 enabling a certain quantity of liquid to be retained when the device is tilted or shaken, said quantity of liquid then flowing along the pump body 7 into the reception member 6 under the effect of gravity when the device is put back upright up. This implementation ensures transfer of a maximum amount of liquid into the cup, particularly when little liquid remains in the receptacle.

When the pump is actuated, all or part of the volume 15 of liquid is sucked in through the inlet orifice 5 of the pump which dips into the volume 15 of liquid.

The volume 15 may optionally correspond to the pump being actuated several times over: for example it may correspond to a daily dose of the liquid.

When the volume 15 corresponds to a single actuation of the pump, and if the device is capable of being put down in the upright position, then the device of the invention can put a limit on uncontrolled use by children since it needs to be turned upside-down before being used.

Figure 6:
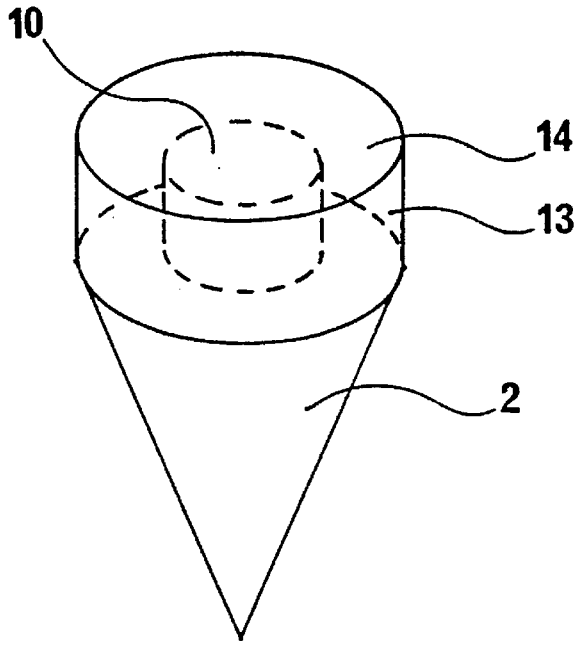
FIGS. 6 and 7 are diagrammatic views of two possible outside shapes for the device of the invention.
Figure 7:
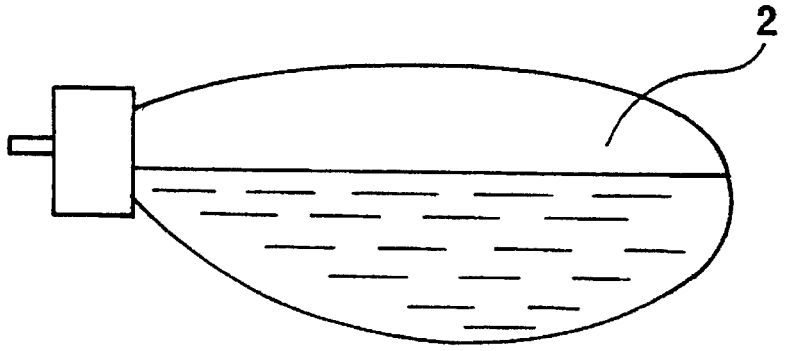

Advantageously, as shown in FIGS. 6 and 7, the shape of the device may be such as to ensure that it can be put down in stable equilibrium only in an inclined or on its side position, e.g. in an upside-down position. In this way, the retention member of the device necessarily retains liquid when the user takes the device and turns it upright up in order to actuate it. In the example of FIG. 6, the receptacle is conical in shape and the device also includes a cylindrical cover 13 having a flat bottom 14 that enables the device to be put down in the upside-down position. In the example of FIG. 7, the receptacle is ovoid in shape, thereby enabling it to be put down in a recumbent position.

In a variant, the pump 1 in the devices described and shown in the figures could optionally be replaced by an aerosol valve.

We claim:

1. A liquid dispenser device including a dispenser mounted on a receptacle containing said liquid, in which the liquid forms a free surface inside the receptacle, the dispenser includes an inlet orifice which is disposed above said free surface during normal operation of the dispenser, and no suction tube is provided; wherein the dispenser is a liquid dispensing pump including a pump body, and wherein the device includes a liquid retention member disposed in said receptacle above said free surface during normal operation of the dispenser, said liquid retention member communicating with said inlet orifice of the pump and with the receptacle, said liquid retention member being adapted to receive a certain volume of liquid when the device is shaken or tilted relative to an upright position in which the pump is at the top of the receptacle, and being adapted to retain said volume of liquid in communication with said inlet orifice of the pump when the device is in said upright position.

2. A device according to claim 1, in which the retention member is in the form of a cup which is disposed around and beneath the pump when the device is in said upright position.

3. A device according to claim 1, in which said retention member is fixed to the pump body.

4. A device according to claim 3, in which said retention member is engaged on a bottom end of the pump body by ribs.

5. A device according to claim 3, in which said retention member includes a bottom and a cylindrical side wall having an outside diameter that is slightly less than an inside diameter of a neck of the receptacle, the retention member further including a plurality of flexible tabs disposed around a top edge of the side wall and flaring towards the neck of the receptacle in a direction that makes an angle with the vertical, the top ends of said flexible tabs defining a circle having a diameter greater than said inside diameter of the neck of the receptacle, said flexible tabs folding inwards when the said retention member is put into place inside the neck of the receptacle and then returning to a flared shape, while the pump is being mounted on the receptacle.

6. A device according to claim 1, in which said retention member is fixed to a neck of the receptacle.

7. A device according to claim 6, in which said retention member includes a bottom and a cylindrical side wall having an annular surface at a top edge thereof extending substantially horizontally outwards from said retention member, said annular surface resting on a top end of the neck of the receptacle, the cylindrical side wall of the retention member including at least one opening enabling liquid to pass from the container into the retention member.

8. A device according to claim 7, in which said retention member includes a substantially cylindrical rim around an outside end of said horizontal annular surface and extending both ways from said annular surface, said cylindrical rim including fixing means in a bottom portion for fixing to the neck of the receptacle.

9. A device according to claim 8, in which said fixing means include snap-fastening tabs that engage the neck of the receptacle, said cylindrical rim being of the snap-fastening ring type.

10. A device according to claim 8, in which said fixing means include an inside thread that co-operates with an outside thread on the neck of the receptacle, said cylindrical rim being of the screw cap type.

11. A device according to claim 6, in which said retention member is made of a material that is sufficiently flexible to act as a sealing gasket in the neck of the receptacle.

12. A device according to claim 1, in which the pump body has ribs or grooves in a portion thereof situated inside the container serving to retain a quantity of liquid when the device is tilted or shaken, said quantity of liquid then flowing along the pump body into the retention member under the effect of gravity when the device is put back into the upright position.

13. A device according to claim 1, wherein the receptacle has an exterior shape configured to render the device unstable in said upright position, and stable in a tilted or upside-down position.

14. A device according to claim 1, in which the receptacle is made of transparent material.

* * * * *